US009966675B2

(12) United States Patent
Wortberg et al.

(10) Patent No.: US 9,966,675 B2
(45) Date of Patent: May 8, 2018

(54) POWER DISTRIBUTOR FOR A VEHICLE

(71) Applicant: Lisa Draexlmaier GmbH, Vilsbiburg (DE)

(72) Inventors: Michael Wortberg, Dorfen (DE); Peter Fuessl, Vilsbiburg (DE); Martin Seidenschwand, Landshut (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 136 days.

(21) Appl. No.: 15/195,471

(22) Filed: Jun. 28, 2016

(65) Prior Publication Data

US 2016/0375847 A1 Dec. 29, 2016

(30) Foreign Application Priority Data

Jun. 29, 2015 (DE) ..... 10 2015 110 420
Jun. 27, 2016 (DE) ..... 10 2016 111 690

(51) Int. Cl.
*H01R 13/66* (2006.01)
*H01R 9/22* (2006.01)
*H01H 85/20* (2006.01)

(52) U.S. Cl.
CPC ..... *H01R 9/226* (2013.01); *H01H 85/20* (2013.01); *H01R 2201/26* (2013.01)

(58) Field of Classification Search
CPC ..... Y10T 307/461; Y10T 307/492; H01R 2201/26
USPC ..... 307/9.1, 10.1
See application file for complete search history.

(56) References Cited

U.S. PATENT DOCUMENTS 4,956,561 A * 9/1990 Tamer ..... H01R 13/665 307/10.1
5,581,130 A 12/1996 Boucheron
5,831,814 A 11/1998 Hamill
(Continued)

FOREIGN PATENT DOCUMENTS

DE 103 11 396 A1 9/2004
DE 10 2004 021 317 A1 11/2005
(Continued)

OTHER PUBLICATIONS

Translated claims for DE10216111690, from EPO Translate, Jan. 6, 2018.*
(Continued)

*Primary Examiner* — Fritz M Fleming
(74) *Attorney, Agent, or Firm* — Finnegan, Henderson, Farabow, Garrett & Dunner LLP

(57) ABSTRACT

Embodiments disclose a power distributor for a vehicle, comprising a printed circuit board for diagnosis and/or for controlling a power supply of a plurality of electrical loads connected to the power distributor, and a bus bar comprising a plurality of first plug contact parts. According to the present disclosure, the printed circuit board comprises a switch part for collectively controlling the power supply of multiple electrical loads via the bus bar disposed separately from the printed circuit board, wherein the first plug contact part of the bus bar together with a second plug contact part disposed on the printed circuit board form a plug contact pair, and a load connected to the respective second plug contact part can be supplied via each plug contact pair.

20 Claims, 4 Drawing Sheets

(56) References Cited

U.S. PATENT DOCUMENTS

| | | | | |
|---|---|---|---|---|
| 6,469,404 | B1 * | 10/2002 | Pohjola | H02J 13/0003 307/10.1 |
| 6,472,770 | B1 * | 10/2002 | Pohjola | B60R 16/0315 307/10.1 |
| 6,489,693 | B1 * | 12/2002 | Hetzler | G01R 19/0092 307/10.1 |
| 2004/0227402 | A1 | 11/2004 | Fehr et al. | |
| 2006/0040526 | A1 | 2/2006 | Shirota | |
| 2006/0261843 | A1 | 11/2006 | Kraft et al. | |
| 2010/0038133 | A1 | 2/2010 | Senk et al. | |
| 2013/0033101 | A1 * | 2/2013 | Kaltenbrunner | B60R 16/03 307/9.1 |
| 2014/0198467 | A1 | 7/2014 | Shi | |
| 2015/0165992 | A1 * | 6/2015 | Scheele | B60R 16/0239 307/9.1 |

FOREIGN PATENT DOCUMENTS

| | | | |
|---|---|---|---|
| DE | 10 2005 038 862 | A1 | 3/2006 |
| DE | 10 2005 005 236 | A1 | 8/2006 |
| DE | 10 2005 054 350 | A1 | 5/2007 |
| DE | 10 2009 029 166 | A1 | 3/2009 |
| DE | 10 2012 214 366 | A1 | 2/2014 |
| WO | WO 99/61286 | | 12/1999 |

OTHER PUBLICATIONS

Office Action in German Application No. 10 2016 111 690.4, dated Mar. 9, 2017.

* cited by examiner

POWER DISTRIBUTOR FOR A VEHICLE

CROSS-REFERENCE TO RELATED APPLICATION

This application is based upon and claims the benefit of prior German Patent Application No. 10 2015 110 420.2, filed on Jun. 29, 2015, and of prior German Patent Application No. 10 2016 111 690.4, filed on Jun. 27, 2016, the entire contents of which are incorporated herein by reference.

TECHNICAL FIELD

The present disclosure relates to a modular electric power distributor for a vehicle, in particular for a motor vehicle, commercial vehicle, hybrid vehicle or electric vehicle.

BACKGROUND OF THE DISCLOSURE

Electric power distributors are provided in vehicle electrical systems, among other things, to supply a plurality of electrical loads with electric energy. One or more power distributors can be disposed in a vehicle. The power distributors are used to switch electrical loads, optionally for diagnostic purposes or to protect against electrical malfunctions, and to distribute the electric energy to the plurality of electrical loads of the onboard power system that are electrically connected thereto. These power distributors are frequently designed in the form of fuse carriers or fuse boxes, relay boxes, combinations thereof or the like. Moreover, these power distributors are frequently configured depending on the vehicle type and/or depending on the equipment variant.

DE 10 2009 029 166 A1 discloses a modular power distributor for use in vehicles, which comprises a printed circuit board and a bus bar.

Such a power distributor is frequently also equipped with one or more printed circuit boards or the like, which fulfill electronic functions, such as diagnostic functions, within the power distributor. For this purpose, the printed circuit boards are pre-populated with corresponding electrical and/or electronic components. These pre-populated printed circuit boards are then fixedly integrated into the power distributor, for example by embedding or insert-molding the same in a housing of the power distributor. To connect the plurality of electrical loads thereto, the printed circuit boards additionally comprise a plurality of electrical (plug-in) contact elements, solder pads for soldered joints or the like, for electrically conductively connecting electrical lines, which are connected to the electrical loads to be supplied.

DE 10 2012 214 366 A1 describes a switch device for a bus bar-based vehicle power distributor.

US Patent Application 2010/0038133 A1 describes a power distributor comprising a vertical bus bar.

While the configuration of a power distributor ensures a reliable supply and protection of the electrical loads, if applicable, it has been shown that the design, manufacturing, and assembly complexity are comparatively high. A desire therefore exists for a simplification in the manufacture and/or assembly of an electric power distributor.

In addition, topics such as autonomous driving are increasingly gaining in importance. Systems for autonomous driving are subject to high safety requirements to not jeopardize the vehicle occupants. This is combined under the term 'functional safety.'

SUMMARY

Embodiments of the present disclosure create a power distributor that can be manufactured comparatively easily and cost-effectively, using a simpler design.

Embodiments of the present disclosure also ensure aspects of functional safety for connected loads.

This object is achieved by the subject matter of the independent claim. Advantageous refinements of the present disclosure are described in the dependent claims, the description, and the accompanying figures.

An electric power distributor according to the present disclosure for a vehicle comprises a printed circuit board, which includes a plurality of electrical loads connected to the power distributor for diagnosis and/or for controlling a power supply. The power distributor moreover comprises a bus bar including a plurality of first plug contact parts. The number of the first plug contact parts is dependent on the number of electrical loads to be connected to the power distributor. According to the present disclosure, the printed circuit board comprises at least one switch part, for example a relay, a semiconductor switch or the like, for collectively controlling the power supply of multiple electrical loads via the bus bar disposed separately from the printed circuit board. The first plug contact parts of the bus bar in each case together with a second plug contact part disposed on the printed circuit board form a plug contact pair. A load connected to the respective second plug contact part can then be supplied via each of the plug contact pairs formed by the plurality of first and second plug contact parts.

The printed circuit board can be supplied with electric energy from an electric energy source of the vehicle as needed, which then is switched by at least one switch part of the printed circuit board to supply multiple electrical loads of the vehicle with power. To transport this switched electric energy to the multiple electrical loads, the current physically leaves the printed circuit board in that a bus bar for transporting this electric energy is disposed separately from the printed circuit board. The printed circuit board may be spatially bypassed during the transport of the electric power, so that while the printed circuit board fulfills electronic functions (such as diagnostic functions), and in part also electrical functions (such as the switching), the transport of the electric power takes place outside or separately from the printed circuit board. The bus bar is configured to transport the entire electric energy for the entire plurality of electrical loads to be supplied. A second plug contact part is then present on the printed circuit board for each load to be supplied and together with one of the first plug contact parts forms a plug contact pair. It is possible then, however, the share of the entire electric energy that is transported via the respective second plug contact part is only that which is needed for supplying the individual electrical load connected in each case thereto. Each individual second plug contact part can have an accordingly smaller dimension. For the transport of the overall energy or the overall power consumed by the loads, in contrast, the energy leaves the printed circuit board.

Embodiments according to the present disclosure of the electric power distributor provide, for example, to separate the electrical and/or electronic functions of the printed circuit board from the more electromechanical functions of the bus bar (spatially and functionally). Thus the electric energy needed for supplying the plurality of electrical loads with power (i.e. the total energy) is initially switched by the at least one switch part of the printed circuit board. Thereafter, however, the electrical energy is transported via the bus bar disposed separately from the printed circuit board, and only a smaller portion of the transported electric energy, which is accordingly reduced by virtue of the plurality of the electrical loads, is supplied to the respective load via the second plug contact parts of the printed circuit board. As a result, conductors for transporting the electric energy itself on the printed circuit board may not be needed. Alternatively, existing conductors can have a smaller dimension. Overall, conductor material can be saved.

In some embodiments, the manufacture and/or the assembly can be improved so that a more efficient manufacturing method can be selected, both for the printed circuit board and for the bus bar. Furthermore, the design of the printed circuit board can be simplified, and can be produced more cost-effectively as a whole. In addition, this power distributor may offer a high level of modularity, so that it can be easily used across different vehicle types having different equipment variants.

Embodiments according to the present disclosure provide a power distributor comprising at least one second printed circuit board including a number of electronic fuses. The second printed circuit board is provided for electrical loads, for which the functional safety must be ensured. In this way, a redundant supply can be created. This may allow an Automotive Safety Integrity Level (ASIL), such as are described in ISO 26262, of B and a higher ASIL to be implemented. The electronic fuses are designed to control the power supply of the respective connected electrical load. These are electrically coupled via a further bus bar disposed separately from the second printed circuit board. The further bus bar comprises a plurality of further first plug contact parts, which in each case together with a further second plug contact part disposed on the second printed circuit board form a plug contact pair.

An electronic fuse may in general be understood as an electrical and/or electronic protection device. For example, such an electronic fuse may be designed in the form of a circuit, which allows electric malfunctions, such as (hard) short circuits, electric and/or thermal overloads or arcs to be detected or identified. The protection device can deactivate or interrupt certain or all functions or electrical connections of the assembly, for example by the integration of one or more semiconductor switches, upon detection or identification of an electric malfunction.

In some embodiments, as an alternative or in addition, the electronic fuse can also be configured to carry out an electric current measurement, and thereby control the electric energy within the assembly and/or the onboard electrical system in absolute terms. This control can take place either by an implementation within the assembly, or by a separate control unit of the vehicle communicating with the assembly. For example, the electronic fuse can comprise an integrated control unit, for example in the form of a microcontroller.

According to an embodiment of the present disclosure, the respective collectively formed plug contact pair is configured to receive an electrical fuse, which connects the respective first plug contact part to the respective second plug contact part. The respective load to be supplied may thus be protected against excess currents, for example. The electric energy or power is thus transported from the switch part of the printed circuit board, via the bus bar disposed separately thereto, a respective plug contact part of the bus bar, the electrical fuse, and the respective second plug contact part, to the electrical load connected thereto. This embodiment of the power distributor provides the spatial separation of the energy or power transport and a protection of the electrical loads, for example against excess currents.

In some embodiments, for the printed circuit board to also fulfill diagnostic functions, the respective second plug contact part may be connected to the printed circuit board for diagnosing the supply of the electrical load. This connection may take place by inserting the second plug contact part into the printed circuit board, and optionally by soldering the second plug contact part into the printed circuit board. For the diagnosis, the printed circuit board can then comprise components for measurement, and optionally for evaluation, which allow an actual current to be measured and compared to a target current. A connection between the second plug contact part and the components for the diagnosis can take place by way of appropriately designed conductors and/or contact areas for the respective second plug contact part, wherein the conductors can have a comparatively small dimension. In this way, it is possible to diagnose the electrical loads connected to the power distributor.

In some embodiments, for a more simple and cost-effective manufacture and provision of the power distributor, the first plug contact part and the second plug contact part may each be designed as tuning-fork contacts. These can be cost-effectively manufactured as stamped/bent parts, for example, and offer a robust and durable connection option for electrical fuses and the like.

In some embodiments, the power distributor can be provided in a more simple, robust and cost-effective design when the plurality of the first plug contact parts are designed in one piece with the bus bar. The entire bus bar can accordingly be manufactured as a comparatively cost-effective stamped/bent part from an electrically conductive sheet metal material. Moreover, the bus bar can be easily adapted to the number of loads to be supplied and the energy demand thereof, or the power consumption thereof. The bus bar can easily have greater, i.e. thicker, dimensions for the transmission of comparatively high electric power.

In some embodiments, the printed circuit board can be provided in a more simple design if the respective second plug contact part is formed on an individual contact element, which is additionally configured for the connection of the electrical load. The respective second plug contact part can thus fulfill a dual function, for example a connection of the respective first plug contact part of the bus bar, and a direct connection of the respective load to be supplied. The individual contact element can be implemented as a stamped/bent part, for example. This can be plugged onto the printed circuit board and/or be soldered thereto.

In some embodiments, for optimal installation space utilization and/or a more simple design of the printed circuit board, the individual contact element may extend through the printed circuit board such that the second plug contact part of the plug contact pair is disposed on a first planar side of the printed circuit board, and a contact tab for connecting the electrical load is disposed on a second planar side of the printed circuit board located opposite the first side. For example, the individual contact element, the number of which provided corresponds to the number of loads to be connected, can comprise multiple contacting zones, which is to say the second plug contact part as a first contacting zone for connecting the electrical fuse, a conductive connection to the printed circuit board, for example for diagnostic purposes, as a second contacting zone, and the contact tab for connecting an electrical load as a third contacting zone. For easier installation of the power distributor, the contact tab can be designed as a plug contact tab onto which the one electrical line, or a plug of a respective electrical load attached thereto, can be easily plugged. As a result of such an individual contact element, the power distributor has a more simple and compact design.

In some embodiments, to be able to install the bus bar provided for transporting electric energy outside the printed circuit board easily, the printed circuit board may comprise at least one fork-shaped bus bar contacting element for connecting the bus bar to the switch part. The fork shape of the bus bar contacting element not only brings about an electrical connection, but also a mechanical fixation of the bus bar. A force-fit and/or form-locked connection of the bus bar to the printed circuit board can thus be provided. The bus bar contacting element can be composed, for example, of a plurality of individual tuning-fork contacts, for example in a lamella-like manner. In this way, the connection between the printed circuit board and the bus bar can also be adapted particularly easily to the energy demand of the electrical loads. For a preferably low consumption of conductor material, the bus bar contacting element can be disposed in the (immediate) vicinity of the switch part.

In some embodiments, for a simpler design of the bus bar and a simpler connection to the printed circuit board, a blade-shaped printed circuit board contacting element for the connection to the printed circuit board is formed on the bus bar. This blade-shaped printed circuit board contacting element can then be brought in contact with, or connected to, a tuning fork-shaped mating contact, for example, comparatively easily by way of insertion or plugging.

In some embodiments, to achieve a level of modularity of the power distributor, the printed circuit board can additionally comprise at least one module contacting element, which is configured for the connection of a universal module. The power distributor can be expandable in a modular fashion compared to the above-described configurations. A universal module in this connection may be understood as a system that comprises at least one bus bar, for example in one of the above-described configurations, and contact options for one or more electrical loads, for example in the manner of a second plug contact part. Via the module contacting element, the universal module connected thereto can be supplied with electric energy, for example either switched by the switch part of the printed circuit board, or directly, this being unswitched. Accordingly, the universal module does not have to comprise a dedicated printed circuit board for the case that the switch part of the printed circuit board is used, and must comprise a dedicated or additional printed circuit board for the case that the supply takes place unswitched. It is also possible for multiple universal modules to be provided, so that the power distributor can be adapted to a large plurality of vehicle types and/or vehicle configurations.

In some embodiments, the module contacting element is a tuning-fork contact. This may be manufactured as a stamped/bent part, for example, and plugged comparatively easily onto the printed circuit board and/or be soldered thereto.

In some embodiments, the universal module can comprise a mating contact element, which is configured to contact the module contacting element. This mating contact element can be designed as a blade contact, for example, for a simpler design composition. The blade contact can optionally be formed in one piece on a bus bar, which then, in turn, comprises a plurality of first plug contact parts. In this way, the design complexity of the universal module can be minimized, but nonetheless a reliable supply of further loads can be ensured.

In some embodiments, the universal module is an exclusively electrical universal module, which can also be diagnosed and/or controlled by the printed circuit board. The printed circuit board of the base module can thus also be used for such a universal module, wherein the switch part is to be dimensioned accordingly.

In some embodiments, the second printed circuit board can comprise a control unit for switch control, additionally or alternatively to the data communication within the vehicle. The control unit disposed on the second printed circuit board is configured to monitor the power supply of the electrical loads connected to the electrical fuses, and to shut these off in the event of a fault. In this way, interference with other electrical loads can be avoided.

In some embodiments, the electronic fuses can be designed as semiconductor fuses. For this purpose, semiconductor components are disposed on a printed circuit board. Using expansion plugs, it is also possible to integrate additional expansion boards or to couple a number of electronic fuses. In one variant, an electronic fuse is defined as a master, and the further electronic fuses connected thereto as slaves. Using appropriate evaluation devices (for example, a control unit), it is possible to integrate arc detection, connection degradation or other measuring and diagnostic methods. It is also possible to implement a pre-charge. By way of diagnostic methods, it is possible to prevent a connection or output from being short-circuited.

In some embodiments, the power distributor comprises a communication interface, which is disposed between the control unit and a higher-level control device and designed in a contactless manner as an optical, inductive or capacitive interface. In this way, the installation of the second printed circuit board can be simplified since the information provided by the control unit, or control commands transmitted to the same, can be relayed in a contactless manner to a vehicle communication network. The vehicle communication network may be a CAN bus, FlexRay, Ethernet or the like, for example.

In some embodiments, a redundant power supply is provided to ensure the functional safety for the connected electrical loads. This can take place in the form of a voltage source, such as back-up battery or an energy buffer store. The "normal" power supply generally takes place via an energy backbone or a bus bar, which is connected to a primary power supply or a primary energy store. This primary energy supply can be coupled via a supply bus bar of the power distributor, or is coupled thereto when installed in the motor vehicle. A redundancy bus bar of the power distributor can be coupled to the secondary power supply, or is coupled thereto when installed in the motor vehicle. The supply bus bar coupled to the primary power supply is coupled via the switch part to the bus bar of the printed circuit board, and via a contact device to the further bus bar of the second printed circuit board. The primary power supply is then present on both printed circuit boards. The redundant power supply is coupled via the redundancy bus bar to at least one electronic fuse of the second printed circuit board. The number of electronic fuses electrically connected to the redundancy bus bar can thus provide a redundant power supply. An electronic fuse can then either be connected only to the primary power supply, or only to the secondary or redundant power supply, or to both, depending on the ASIL or required safety of the power supply.

In some embodiments, a current flowing across the number of electronic fuses, and additionally or alternatively a voltage flowing across the number of electronic fuses, can be monitored by the control unit of the second printed circuit board, or by control units of the respective electronic fuse. When a threshold value is exceeded, the respective electronic fuse, or the electrical load connected to the latter, can be shut off. The effects of a fault can thus be isolated.

In some embodiments, the power distributor can additionally comprise a temperature monitoring device, which is designed to activate the switch part of the first printed circuit board, and thus shut off the electrical loads connected thereto. Via the control unit on the second printed circuit board, or the control units of the electronic fuses, the optional temperature monitoring device is furthermore designed to activate the same when a limit temperature is exceeded, and to shut off the connected electrical loads.

In some embodiments, an electrical load can be couplable or coupled both via the printed circuit board and via an electronic fuse disposed on the second printed circuit board. In this way, a second supply path can be provided to reduce a probability of failure.

According to embodiments of the present disclosure, the functional safety can be improved or ensured by way of the second printed circuit board. In one variant, at least one of the electrical loads can thus be couplable or coupled via a first electronic fuse disposed on the second printed circuit board, and via a second electronic fuse disposed on the second printed circuit board. In this way, a redundant power supply can be implemented via the second printed circuit board. In this case, the first electrical fuse can be coupled or is coupled at least to the supply bus bar, and the second electrical fuse can be coupled or is coupled at least to the redundancy bus bar.

The properties, features and advantages of the present disclosure as described, and the manner in which these are achieved, will become more apparent and understandable in connection with the following detailed description, which will be described in more detail in connection with the drawings. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

BRIEF DESCRIPTION OF THE FIGURES

The figures are only schematic representations and are provided only to explain the present disclosure. Like elements are uniformly denoted by like reference numerals.

DETAILED DESCRIPTION

Figure 1:
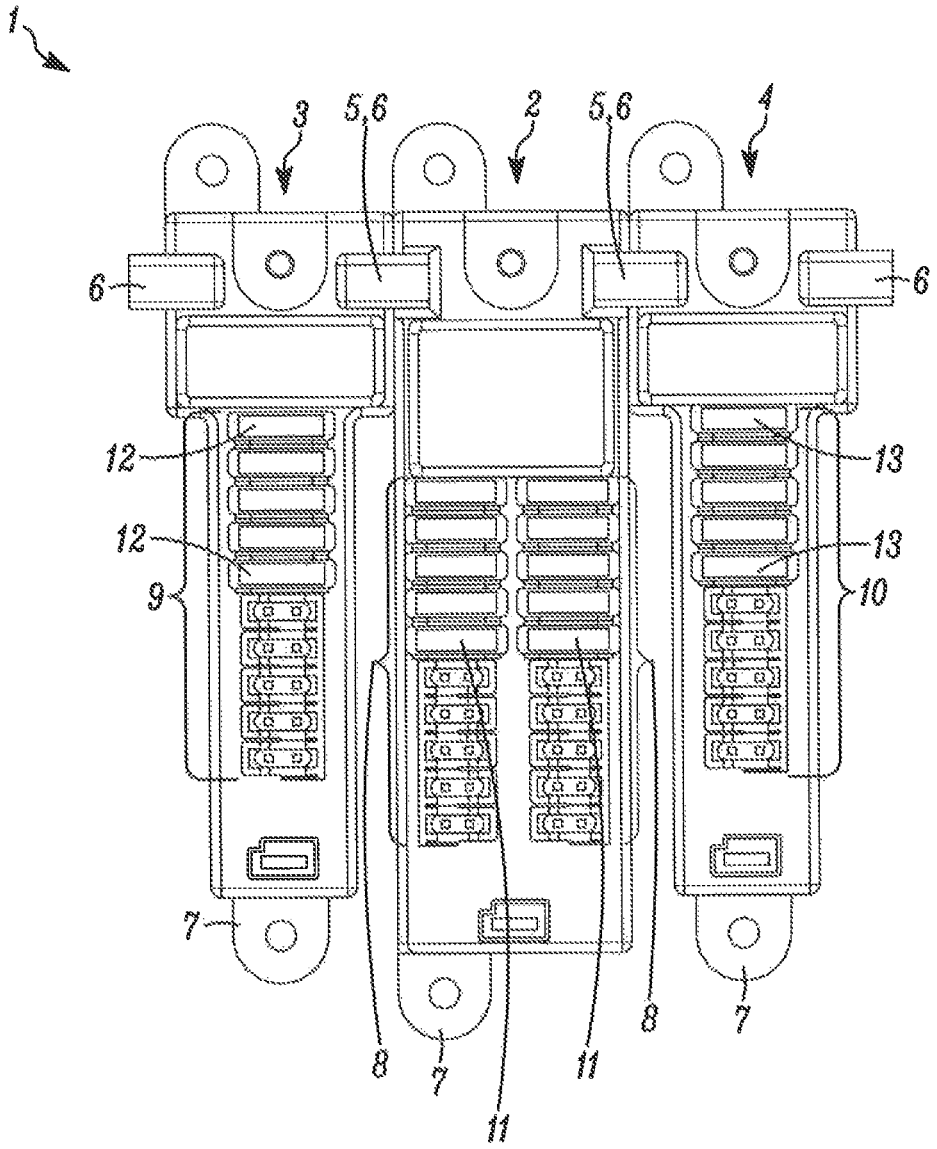
FIG. 1 shows a top view onto an exemplary modular electric power distributor according to the present disclosure.

FIG. 1 shows a top view onto an exemplary modular electric power distributor 1 for a vehicle (not shown). Such a power distributor 1 is used, for example, to supply a plurality of electrical loads (also not shown) with electric energy via a plurality of electrical lines, and to monitor this supply by way of diagnosis. Accordingly, the power distributor 1 is configured to ensure a power supply, and optionally to provide a diagnosis of the electrical loads connected thereto.

FIG. 1 shows that the modular power distributor 1 includes a base module 2 and multiple universal modules 3 and 4, wherein in this exemplary embodiment exactly two universal modules are provided only by way of example. This means that the base module 2 and the multiple universal modules 3 and 4 can be joined to yield the modular power distributor 1. To connect the base module 2 and the universal modules 3 and 4 electrically conductively and/or communicatively among each other and to the electrical loads of the vehicle to be supplied, a module contacting element 5 and a corresponding mating contact element 6 are each provided on the base module 2 and on each universal module 3 and 4. The module contacting elements 5 are tuning fork-shaped, and the mating contact elements 6 are blade-shaped, so that they not only form an electrical contact, but also engage each other in a form-locked and/or force-fit manner for forming a mechanical connection. To fasten the power distributor 1, or the base module 2 thereof and the universal modules 3 and 4 thereof, to the vehicle to be equipped therewith, they have one or more fastening eyelets 7.

As shown in FIG. 1, the base module 2 and each of the universal modules 3 and 4 include a plurality of electrically conductive plug contact pairs 8, 9 and 10, in which in this representation an electrical (flat) plug-in fuse made of a plurality of (flat) plug-in fuses 11, 12 and 13 is partially disposed. In this exemplary embodiment, the middle base module in FIG. 1 has a double-row design with respect to the plug contact pairs 8 thereof and the plug-in fuses 11 that can be received. The further universal modules 3 and 4, in contrast, have only a single-row design, wherein this configuration is selected only be way of example here, so that it is also possible to provide multiple single-row or multiple multiple-row universal modules. The design composition of the power distributor 1 shall be described hereafter based on the middle base module 2 in FIG. 1, which has a double-row design with respect to the plug contact pairs 8 thereof.

Figure 2:
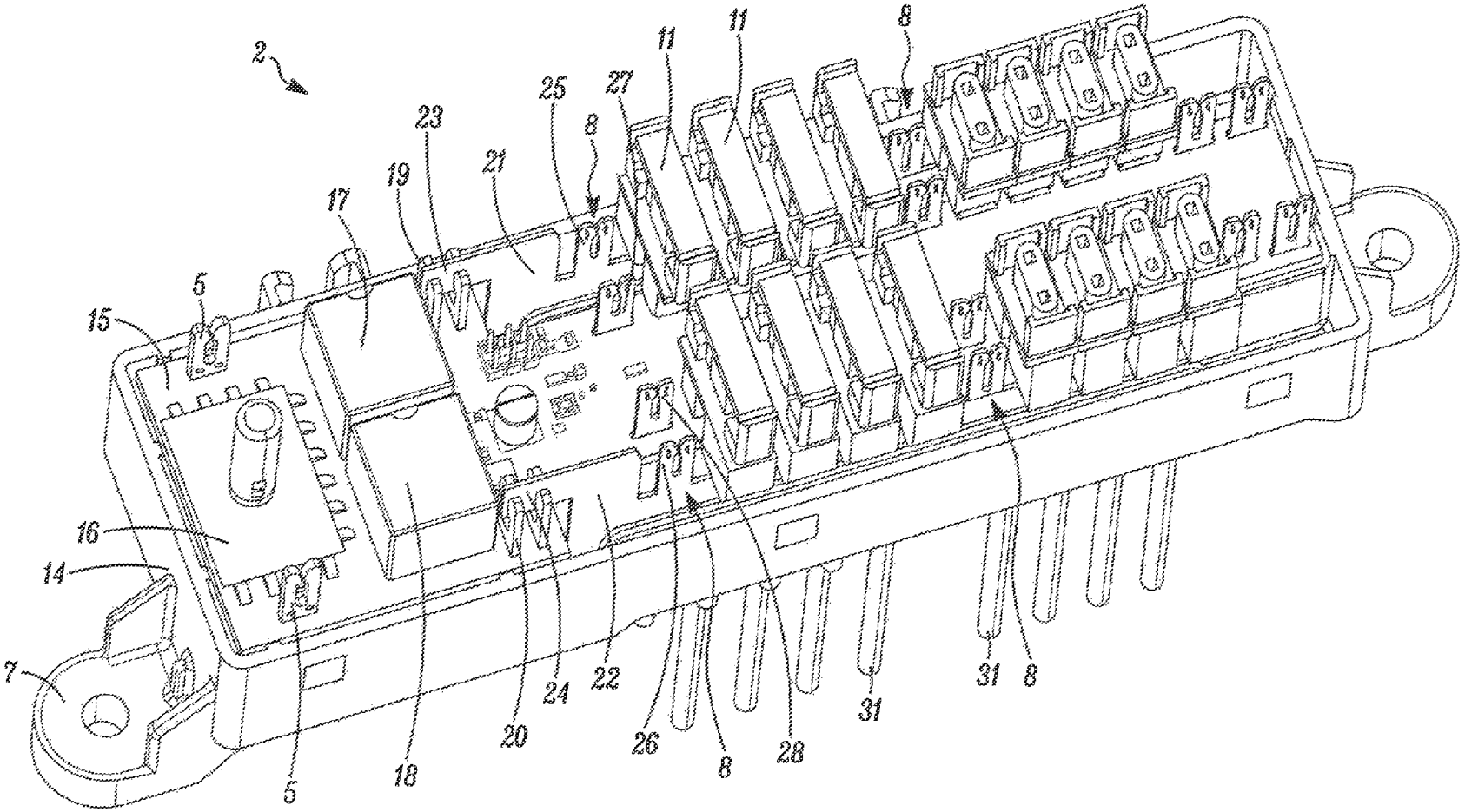
FIG. 2 shows a perspective top view onto an exemplary base module comprising a printed circuit board of an electric power distributor according to the present disclosure, in which two bus bars for the transport of electric energy are disposed separately from the printed circuit board, and first plug contact parts of the bus bar in each case together with a respective second plug contact part form a plug contact pair for connecting an electrical load.

FIG. 2 correspondingly shows the middle base module 2 of FIG. 1 in a perspective top view. The universal module 2 of the power distributor 1 comprises a housing 14, which is partially removed in FIG. 2 for the sake of better illustration. In particular, only a lower housing half of the housing 14 is shown. A printed circuit board 15 pre-populated with electrical and/or electronic components or assemblies is received in the housing 14. The printed circuit board 15 comprises a power supply contact 16, via which the power distributor 1 can be supplied with electric energy of an energy source (not shown) of the vehicle, for example a vehicle battery or the like. For example, the power distributor 1 can be supplied via the power supply contact 16 with the permanent positive of the vehicle battery, or via what is known as the terminal of the vehicle.

As shown in FIG. 2, the illustrated base module 2 comprises two of the module contacting elements 5 on the printed circuit board 15. Moreover, the remaining universal modules 3 and 4 can be connected to the base module 2 and be supplied by the same with electric energy via the power supply contact 16 supplied by the energy source of the vehicle. For this purpose, corresponding conductors are provided on the printed circuit board 15 from the power supply contact 16 to the two module contacting elements 5. In this exemplary embodiment, the module contacting elements 5 are each designed as tuning-fork contacts. Correspondingly, the respective mating contact elements 6 on the universal module side are each designed as blade contacts, which are caused to engage with the tuning-fork contacts and thereby establish an electrically conductive connection.

As shown in FIG. 2, the printed circuit board 15 includes a first switch part 17 and a second switch part 18, which are each designed as relays here by way of example. However, the switch parts 17 and 18 can also be designed as semiconductor switches or in another manner. The first switch part 17 and the second switch part 18 are each configured to switch a voltage present at the power supply contact 16 as needed, and thus supply in each case one of the two rows consisting of the respective plug contact pairs 8 with voltage or electric energy. In this exemplary embodiment a respective dedicated switch part 17 and 18 for switching a power supply is provided for each of the rows of plug contact pairs 8.

A first bus bar contacting element 19, which in this exemplary embodiment is designed in the form of two individual tuning-fork contacts, is disposed in the (immediate) vicinity of the first switch part 17. This tuning fork shape allows electrical contacting and also creates a robust mechanical connection. The number of bus bar contacting elements 19 is selected both based on the electric energy to be transmitted thereby and for the tilt stability of the bus bar held mechanically therein. The first bus bar contacting element 19 is electrically conductively connected to the first switch element 17 via one or more corresponding conductors of the printed circuit board 15, so that a voltage switched by the first switch part 17 is present at the first bus bar contacting element 19.

A second bus bar contacting element 20, designed in the form of two individual tuning-fork contacts, is also disposed in the (immediate) vicinity of the second switch part 18. The second bus bar contacting element 20 is also electrically conductively connected to the second switch element 18 via one or more corresponding conductors of the printed circuit board 15, so that a voltage switched by the second switch part 18 is present at the second bus bar contacting element 20. The number of mutually parallel bus bar contacting elements 19 and 20 and the dimensions thereof are dependent on the overall electric power required for supplying the electrical loads, among other things. It is possible that comparatively short conductors are sufficient due to the immediate vicinity of the two bus bar contacting elements 19 and 20 in relation to the respective switch part 17 and 18.

As shown in FIG. 2, a first bus bar 21 extending along a longitudinal side of the printed circuit board 15 and spaced apart therefrom is disposed in the first bus bar contacting element 19. A second bus bar 22 likewise extending along a longitudinal side of the printed circuit board 15 and spaced apart therefrom is disposed in the second bus bar contacting element 20. The first bus bar 21 and the second bus bar 22 accordingly extend along the printed circuit board 15 parallel to each other at a respective predetermined distance and/or with shielding from the printed circuit board. In this exemplary embodiment, a blade-shaped printed circuit board contacting element 23 or 24 is formed on the first bus bar 21 and the second bus bar 22 in each case in one piece with the same. The printed circuit board contacting elements 23 and 24 are inserted into the respective first bus bar contacting element 19 and the respective second bus bar contacting element 20, and via the resultant contact are electrically conductively connected thereto. Accordingly, approximately the voltage that is present at the power supply contact 16 can be applied at the first bus bar 21 and the second bus bar 22.

The first bus bar 21 and the second bus bar 22 shown in FIG. 2 are each designed as stamped/bent parts made of a sheet metal material having good electrical conductivity. The dimensioning of the bus bars 21 and 22 is dependent, among other things, on the overall electric power required for supplying the electrical loads connected to the power distributor 1. The first bus bar 21 and the second bus bar 22 each include a plurality of first plug contact parts 25 and 26 formed in one piece with the respective bus bar 21 and 22. The first plug contact parts 25 of the first bus bar 21, and the first plug contact parts 26 of the second bus bar 22, in each case form a component of the plug contact pairs 8 into which the plug-in fuses 11 can be inserted. The first plug contact parts 25 and 26 are each designed as tuning-fork contacts here.

As shown in FIG. 2, a plurality of second plug contact parts 27 and 28 are disposed in each case on the printed circuit board 15 for each of the two rows of plug contacts 8. These second plug contact parts 27 and 28 in each case form a further component of the plug contact pairs 8 into which the plug-in fuses 11 can be inserted. For this purpose, the second plug contact parts 27 and 28 are each disposed on the printed circuit board 15 such that each second plug contact part 27 and 28 cooperates with a corresponding first plug contact part 25 and 26 disposed parallel thereto, and forms exactly one plug contact pair 8. Correspondingly, the second plug contact parts 27 and 28 are each designed individually, but likewise as tuning-fork contacts. In contrast to the first plug contact parts 25 and 26, the second plug contact parts 27 and 28 are not supplied directly (for example via appropriate conductors) with a voltage switched by the switch parts 17 or 18. The power transmission required to supply electrical loads with electric energy thus takes place via the respective bus bar 21 or 22 to the first plug contact parts 25 and 26, but not via the printed circuit board 15 to the second plug contact parts 27 and 28. This functional and spatial separation of the power transmission from the printed circuit board 15 accordingly also allows conductor material, such as copper (Cu), to be saved.

As shown in FIG. 2, the respective second plug contact parts 27 and 28 are each plugged onto the printed circuit board 15 and extend through the same from a first planar side to a second planar side located opposite thereof. The respective second plug contact parts 27 and 28 are additionally in conductive contact with the printed circuit board 15 and are soldered thereto. This contact serves to connect the second plug contact parts 27 and 28 to the printed circuit board 15, which for diagnostic purposes can carry out a current measurement, arc detection or the like via this contact.

Figure 3:
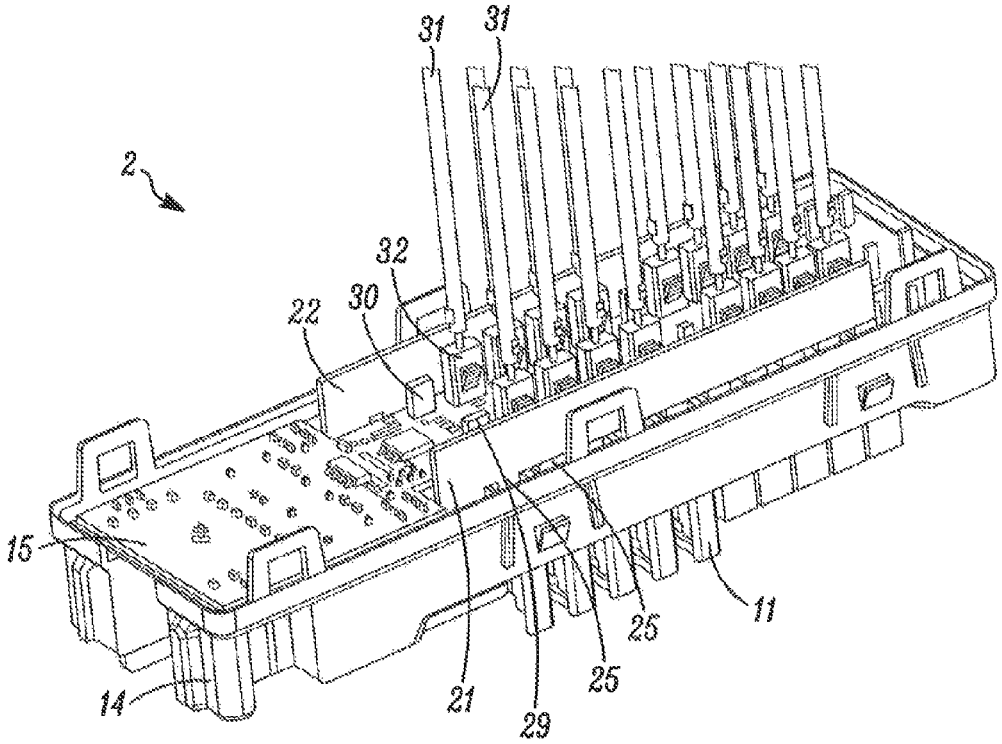
FIG. 3 shows a perspective bottom view of an exemplary base module according to the present disclosure of an electric power distributor, in which electrical loads are connected to second plug contact parts, the loads being supplied with electric energy via bus bars disposed separately from a printed circuit board.

FIG. 3 shows the base module 2 in a perspective bottom view. The respective second plug contact parts 27 and 28 are each designed as individual contact elements and extend through the printed circuit board 15. On the side of the printed circuit board 15 shown here, the respective second plug contact parts 27 and 28 comprise a contact tab 29 and 30, respectively, formed in one piece therewith, which are used to connect an electrical load of the vehicle via an electrical line. In the shown exemplary embodiment, accordingly a plurality of electrical lines 31 having plug connectors 32 attached thereto are connected to the respective contact tabs 29 and 30 of the respective second plug contact parts 27 and 28.

As shown in FIG. 3, the first bus bar 21 and the second bus bar 22 extend along the printed circuit board 15. As described above, the dimensioning of the first bus bar 21 and of the second bus bar 22 is dependent, among other things, on how much electric power is to be transmitted to supply the electrical loads. FIG. 3 also shows that the contact tabs 29 and 30 of the second plug contact parts 27 and 28 designed as individual contact elements are configured to receive the plug connectors 32 of the electrical lines 31.

Figure 4:
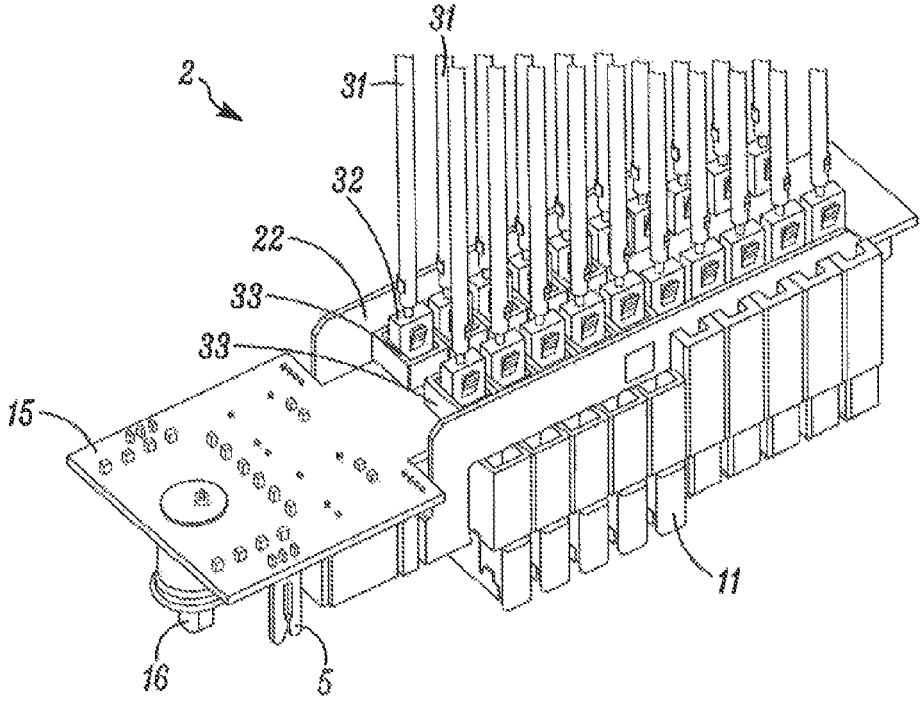
FIG. 4 shows a perspective bottom view of the base module of the power distributor of FIG. 3, in which the second plug contact parts are embedded in a plastic material.

FIG. 4 also shows the base module 2 in a perspective bottom view. The respective contact tabs 29 and 30 of the second plug contact parts 27 and 28 can be insert-molded with a thermoplastic polymer, for example, or be embedded in the housing 14 of the base module 2 in another manner. This can take place in each case in the form of a socket 33, which also retains and secures the respective electrical line 31, or the plug connector 32 thereof, on the respective contact tab 29 or 30.

A possible operation of the power distributor 1 shall be described hereafter based on FIGS. 1 and 2.

Depending on the vehicle-side requirements with regard to the power distributor 1, this includes the base module 2 and the universal modules 3 and 4 shown in a top view in FIG. 1 in this exemplary embodiment. These are electrically conductively connected to each other via the tuning fork-shaped module contacting elements 5 and the blade-shaped mating contact elements 6.

The base module 2, which in FIG. 2 is shown in a perspective top view with a partially removed housing 14, is connected via the power supply contact 16 of the printed circuit board 15 to an energy source of the vehicle, such as a permanent positive of the vehicle battery. Via the module contacting elements 5, which are likewise connected to the power supply contact 16 via appropriate conductors of the printed circuit board 15, the remaining universal modules 3 and 4 are also supplied with the voltage present thereon.

Within the base module 2, either one or both of the switch parts 17 and 18 can be prompted to switch the power supply, so that the voltage present at the power supply contact 16 is connected through to the directly adjoining bus bar contacting elements 19 and 20. In this way, the power being transmitted leaves the printed circuit board 15 at this location, and the entire electric power required for supplying the electrical loads connected to the respective second plug contact parts 25 and 26 is transported exclusively via the respective bus bar 21 and 22 along, and separately from, the printed circuit board 15. Due to the separate design and arrangement of the bus bars 21 and 22 in relation to the printed circuit board 15, a structural and spatial separation of the power transmission from the printed circuit board 15 is thus achieved, so that the same can have correspondingly fewer, or at least correspondingly smaller dimensioned, conductors.

Via the respective plug contact pairs 8, which are each formed by one of the first plug contact parts 25 and 26 designed in one piece with the respective bus bar 21 and 22 and one of the second plug contact parts 27 and 28 disposed individually on the printed circuit board 15, the electric power diverted at the bus bar contacting elements 19 and 20 to the bus bars 21 and 22 is divided among the individual electrical loads connected to the second plug contact parts 27 and 28. This means that each individual second plug contact part 27 and 28 has to transmit only the electric power required for supplying the respective electrical load connected thereto. This accordingly low share of the overall electric power is transmitted from the respective bus bar 21 and 22 via the respective first plug contact part 25 and 26, the plug-in fuse 11 plugged onto the formed plug contact pair 8, and the respective second plug contact part 27 and 28 to the individual electrical loads.

The electric power distributor 1 according to the present disclosure can be modified in a variety of ways. For example, it is contemplated that multiple universal modules are provided, which comprise a printed circuit board 15. Each universal module 3 and 4, and each (expansion) universal module, can exclusively be provided with electrical or electronic components, for example without a dedicated printed circuit board.

For diagnosing an electrical connection of the electrical loads, appropriate measuring devices and/or evaluation devices, for example for current measurement for the purpose of detecting an excess current or short circuit, or for arc detection, can be provided on the printed circuit board 15. For this purpose, appropriate conductors may be formed on the printed circuit board 15, among other things, to the second plug contact parts 27 and 28 designed as individual contact elements.

Figure 5:
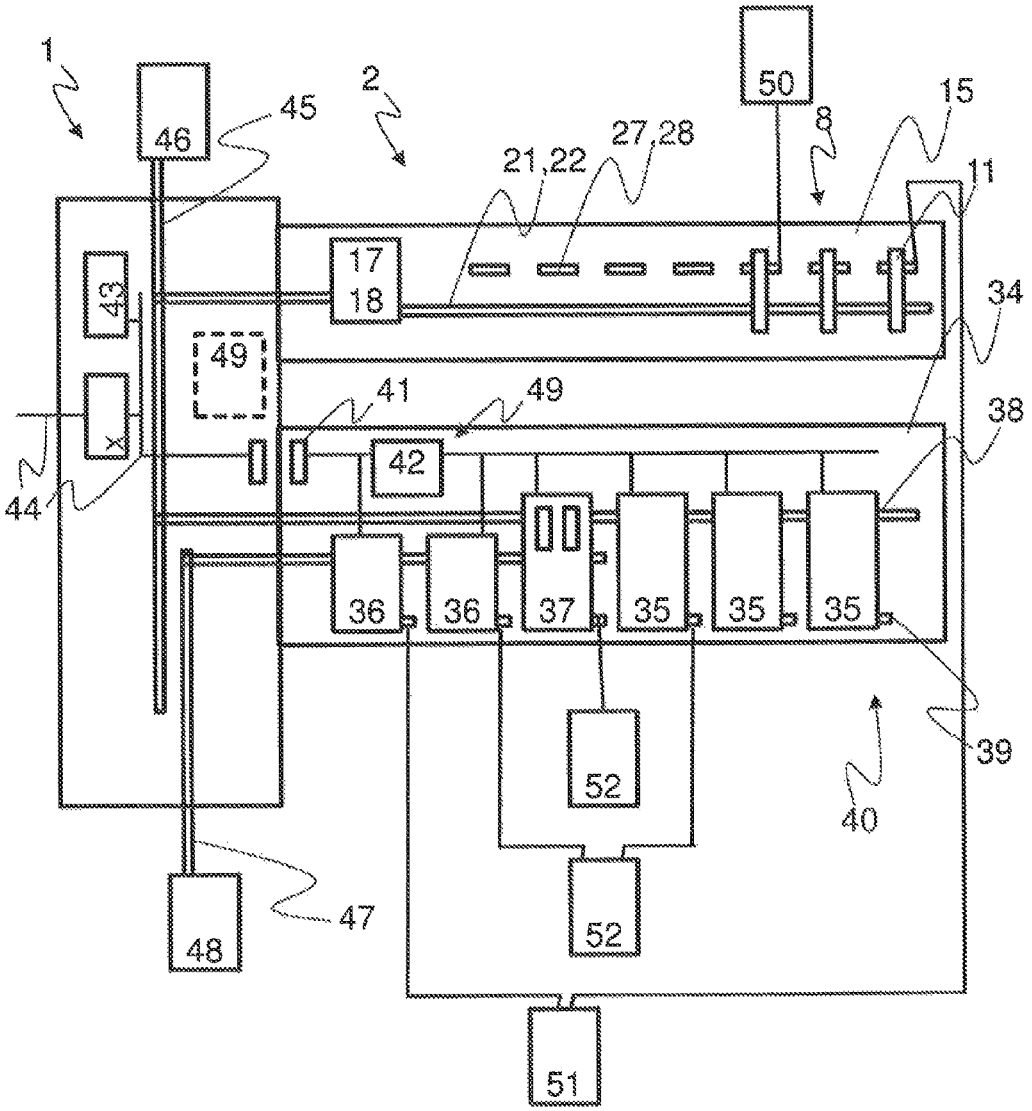
FIG. 5 shows a schematic representation of a power distributor according to an exemplary embodiment of the present disclosure.

FIG. 5 shows a schematic representation of a power distributor 1 according to one exemplary embodiment of the present disclosure. As described in detail in the preceding figures, a base module 2 comprises a switch part 17, 18, which is disposed on a printed circuit board 15 and via which a bus bar 21, 22 disposed separately from the printed circuit board 15 can be supplied with current/voltage from a primary power supply 46. Via plug contact parts 27, 28, which form part of a plug contact pair 8 and are connected via a fuse 11, electrical loads 50 are supplied with the current provided via the bus bar 21, 22. All electrical loads connected to the printed circuit board 15 can be disconnected simultaneously from the current supply/power supply via the switch part 17, 18.

The power distributor 1 may furthermore comprise a second printed circuit board 34 including a number of electronic fuses 35, 36, 37. The electronic fuses 35, 36, 37 are configured to electrically supply a respective electrical load 51, 52 and activate the corresponding power supply. For this purpose, the electronic fuses 35, 37 are connected via a further bus bar 38 disposed separately from the second printed circuit board 34. A plurality of further first plug contact parts are disposed or formed on the further bus bar 38, and thus are electrically connected to the further bus bar 38. The further first plug contact parts, together with a respective associated further second plug contact part 39 disposed on the second printed circuit board 34, in each case forms a plug contact pair 40. The plug contact pairs 40 are connected to each other via the electronic fuse 35, 37.

The plurality of electronic fuses 35, 36, 37 are connected via control lines to a control unit 42. These are generally bidirectional communication lines, so that these are used to transmit both status information about the electronic fuse 35, 36, 37 to the control unit 42, and control commands from the control unit 42 to the electronic fuses 35, 36 37. Depending on the exemplary embodiment, the control lines are analog or digital control lines, which can also be implemented as bus lines, such as CAN bus.

The control unit 42 is connected to a vehicle communication network 44 via an optional communication interface 41. Manufacturing-related advantages may be provided if the communication interface 41 is designed to be contactless, as in the shown exemplary embodiment. In different variants, capacitive, inductive or optical transmission methods are employed.

In the exemplary embodiment shown in FIG. 1, the power distributor 1 is connected to the primary power supply of the motor vehicle via a supply bus bar 45. In addition, a secondary power supply 48 is provided. In one variant, this is implemented, for example, as a back-up battery 48, or alternatively via a buffer store 48 integrated into the power distributor 1. The power distributor 1 comprises a redundancy bus bar 47, which is connected to the secondary power supply 48.

The redundancy bus bar 47 is electrically connected to the electronic fuses 36, 37 of the second printed circuit board 34.

Electrical loads 50, 51, 52 are now connected to the power distributor 1 based on the type of the load 50, 51, 52. FIG. 5 shows three loads 50, 51, 52 by way of example. They each represent a plurality of loads having comparable requirements with regard to the functional safety. The first load 50 is connected via the printed circuit board 15 to the power distributor 1. The second load 51 is connected to the power distributor via the printed circuit board 15, and via the printed circuit board 34. A connection to an electronic fuse 36, 37 is useful to ensure a connection to the second power supply 48. A third load 52 is connected via one of the fuses 37 to the power distributor 1. Alternatively, the load 52 is connected to the power distributor via a fuse 35 and a fuse 36. Both variants provide an ASIL-compliant redundant power supply.

An additional, optional feature of the power distributor 1 is the temperature monitoring device 49. In the shown exemplary embodiment, this is integrated into the control unit 42. Sub-functions can also be assigned to the electronic fuses 35, 36, 37.

As described in greater detail above, one property of the power distributor 1 is modularity. The power distributor 1 can be expanded by further universal modules, for example comparable to the printed circuit board 15 and all connections implemented here, and by further intelligent modules, such as the printed circuit board 34 described here in detail comprising the electronic fuses 35, 36, 37 and the control unit 42.

In one exemplary embodiment (not shown in the figures), the power distributor 1 comprises at least two printed circuit boards 34. An electrical load 51, 52, which represents a functional safety-relevant load, is connected via an electronic fuse 37 of the first printed circuit board 34, and via an electronic fuse 37 of the second printed circuit board 34, both to the primary power supply 46 and to the secondary power supply 48. This configuration may improve functional safety if, via the first printed circuit board 34, a supply is provided via the primary power supply 46, and via the second printed circuit board 34, a supply is provided via the secondary power supply 48. In this way, a functional safety-relevant load 51, 52 is connected to an electronic fuse 35, 37 of the first printed circuit board 34 and, via an electronic fuse 36, 37 of the second printed circuit board 34, to the power supply 46 or power supply 48. Thus, the failure of an individual control unit 42 may not result in the complete failure of the supply of the electrical loads 51, 52.

Deviating from the illustrated exemplary embodiments, the electric/electronic power distributor 1 according to the invention can be modified in a variety of ways. The following examples represent variants that a person skilled in the art would consider in the course of the stated problem. For example, mechanical fuses can be provided on the printed circuit board 15, such as in the form of fusible cutouts. Instead of lamella contacts, non-detachable connections are also in part contemplated from a manufacturing point of view, for example by way of joining or welding. The number of printed circuit boards 15, 34 may be increased in the spirit of modularity, both in the conventional field and in the special field for functional safety.

While the present disclosure is illustrated and described in detail according to the above embodiments, the present disclosure is not limited to these embodiments and additional embodiments may be implemented. Further, other embodiments and various modifications will be apparent to those skilled in the art from consideration of the specification and practice of one or more embodiments disclosed herein, without departing from the scope of the present disclosure.

LIST OF REFERENCE NUMERALS

1 electric/electronic power distributor
2 base module
3 universal module
4 universal module
5 module contacting element
6 mating contact element
7 fastening eyelet
8 plug contact pair
9 plug contact pair
10 plug contact pair
11 electrical fuse
12 electrical fuse
13 electrical fuse
14 housing
15 printed circuit board
16 power supply contact
17 first switch part
18 second switch part
19 first bus bar contacting element
20 second bus bar contacting element
21 first bus bar
22 second bus bar
23 first printed circuit board contacting element
24 second printed circuit board contacting element
25 first plug contact part
26 first plug contact part
27 second plug contact part
28 second plug contact part
29 contact tab
30 contact tab
31 electrical line
32 plug connector
33 socket
34 second printed circuit board
35 electronic fuse
36 electronic fuse
37 electronic fuse
38 further bus bar
39 further second plug contact part
40 plug contact pair
41 communication interface
42 control unit
43 higher-level control device
44 vehicle communication network
45 supply bus bar
46 primary power supply
47 redundancy bus bar

48 secondary power supply
49 temperature monitoring device
50 first (conventional) load, electrical load
51 second (functional safety) load, electrical load
52 third (functional safety) load, electrical load

The invention claimed is:

1. A power distributor for a vehicle, comprising:

a first printed circuit board configured to diagnose and control a power supply of a first plurality of electrical loads connected to the power distributor, the first printed circuit board including a switch part;

a first bus bar including a first plurality of first plug contact parts, the first bus bar disposed separately from the first printed circuit board; and a first plurality of second plug contact parts disposed on the first printed circuit board;

wherein:

the switch part is configured to collectively control the power supply of one or more of the first plurality of electrical loads via the first bus bar;

the first plug contact parts of the first bus bar together with the second plug contact parts of the first printed circuit board form at least one first plug contact pair; and at least one of the first plurality of electrical loads connected to one of the second plug contact parts of the first printed circuit board is supplied via the at least one first plug contact pair; and a second printed circuit board configured to control a power supply of a second plurality of electrical loads, the second printed circuit board including a plurality of electronic fuses;

a second bus bar including a second plurality of first plug contact parts, the second bus bar disposed separately from the second printed circuit board; and wherein:

the first plug contact parts of the second bus bar together with the further second plug contact part of the second printed circuit board form at least one second plug contact pair.

2. The power distributor according to claim 1, wherein the first plug contact pair is configured to receive an electronic fuse connecting the first plug contact parts of the first bus bar with the second plug contact parts of the first printed circuit board.

3. The power distributor according to claim 1, wherein at least one of the first plurality of second plug contact parts is connected to the first printed circuit board for diagnosing the supply of at least one of the first plurality of electrical loads.

4. The power distributor according to claim 1, wherein the first plurality of first plug contact parts and the second plurality of second plug contact parts are each formed as tuning-fork contacts.

5. The power distributor according to claim 1, wherein the first plurality of first plug contact parts are designed in one piece with the first bus bar.

6. The power distributor according to claim 1, wherein the first plurality of second plug contact parts is formed on an individual contact element configured to connect to the first plurality of electrical loads.

7. The power distributor according to claim 6, wherein:

the individual contact element extends through the first printed circuit board such that the first plurality of second plug contact parts is disposed on a first planar side of the first printed circuit board; and a contact tab configured for the connection of the first plurality of electrical loads, is disposed on a second planar side of the first printed circuit board located opposite the first planar side.

8. The power distributor according to claim 1, wherein the first printed circuit board includes at least one tuning fork-shaped bus bar contacting element configured to connect the first bus bar to the switch part.

9. The power distributor according to claim 1, wherein a blade-shaped printed circuit board contacting element is formed on the first bus bar, the blade-shaped printed circuit board contacting element configured to connect to the first printed circuit board.

10. The power distributor according to claim 1, wherein the first printed circuit board further includes a module contacting element configured to connect to a universal module.

11. The power distributor according to claim 10, wherein the module contacting element is a tuning-fork contact.

12. The power distributor according to either claim 10, wherein the universal module includes a mating contact element configured to contact the module contacting element.

13. The power distributor according to claim 10, wherein:

the universal module is an exclusively electrical universal module; and the first printed circuit board is configured to diagnose and control the exclusively electrical universal module.

14. The power distributor according to claim 1, wherein the second printed circuit board includes a control unit configured for switch control and data communication within the vehicle, the control unit further configured to:

monitor the power supply of the second plurality of electrical loads; and shut off the power supply to the second plurality of electrical loads when a fault occurs in the at least one second plug contact pair.

15. The power distributor according to claim 14, further comprising:

a communication interface disposed between the control unit and a higher-level control device, the communication interface designed in a contactless manner as an optical, inductive or capacitive interface.

16. The power distributor according to claim 14, further comprising:

a supply bus bar coupled to a primary power supply; and a redundancy bus bar coupled to a secondary power supply;

wherein:

the supply bus bar is coupled via the switch part to the first bus bar of the first printed circuit board;

the supply bus bar is coupled via a contact device to the second bus bar of the second printed circuit board; and the redundancy bus bar is coupled to at least one of the plurality of electronic fuses of the second printed circuit board.

17. The power distributor according to claim 16, wherein at least one of the second plurality of electrical loads is coupled via a first of the plurality of electronic fuses disposed on the second printed circuit board, and via a second of the plurality of electronic fuses disposed on the second printed circuit board, wherein:

with the first of the plurality of electronic fuses is coupled at least to the supply bus bar; and the second of the plurality of electronic fuses is coupled at least to the redundancy bus bar.

18. The power distributor according to claim 14, wherein the control unit is configured to:

monitor at least one of a current or a voltage flowing across the plurality of electronic fuses; and shut off at least one electronic fuse of the plurality of electronic fuses or at least one of the second plurality of electrical loads when a threshold value is exceeded.

19. The power distributor according to claim 14, further comprising:

a temperature monitoring device configured to shut off the switch part via the control unit of the plurality of electronic fuses when a threshold temperature is exceeded.

20. The power distributor according to claim 14, wherein at least one of the second plurality of electrical loads is coupled both via the first printed circuit board and via one of the plurality of electronic fuses disposed on the second printed circuit board.

* * * * *